US007670177B2

(12) United States Patent
Myer et al.

(10) Patent No.: US 7,670,177 B2
(45) Date of Patent: Mar. 2, 2010

(54) ELECTRICAL CONNECTOR HAVING FLOATING ALIGNMENT MEMBER

(75) Inventors: John Mark Myer, Millersville, PA (US); Hurley Chester Moll, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/140,885

(22) Filed: Jun. 17, 2008

(65) Prior Publication Data

US 2009/0311896 A1 Dec. 17, 2009

(51) Int. Cl.
*H01R 13/40* (2006.01)

(52) U.S. Cl. ..... 439/595

(58) Field of Classification Search ..... 439/595
See application file for complete search history.

(56) References Cited

U.S. PATENT DOCUMENTS 4,797,116 A 1/1989 Isohata et al.
5,993,255 A 11/1999 Yurko
6,004,158 A * 12/1999 Ward ..... 439/595

FOREIGN PATENT DOCUMENTS

DE 88 06 272 6/1988
DE 103 20 460 12/2003
EP 0 948 089 10/1999
EP 1 469 562 10/2004

OTHER PUBLICATIONS

International Search Report, International Application No. PCT/US2009/003357, International Filing Date Mar. 6, 2009.

* cited by examiner

*Primary Examiner*—Tho D Ta

(57) ABSTRACT

An electrical connector includes a dielectric housing having a mating cavity extending to a base wall and at least one terminal cavity through the base wall to the mating cavity. The terminal cavity being configured to receive a terminal therein having a pin extending into the mating cavity. A primary terminal lock extends from an interior wall of the housing and is configured to engage the terminal to retain the terminal in the terminal cavity. An alignment member is received within the mating cavity and has an alignment plate having at least one opening aligned with a corresponding terminal cavity. The alignment member is movable within the mating cavity between a seated position in which the alignment plate is proximate to the base wall and a supporting position in which the alignment plate is positioned remote from the base wall. A tip of the terminal is held within the opening when the alignment member is in the supporting position, and a pin base of the terminal is held within the opening when the alignment member is in the seated position.

19 Claims, 8 Drawing Sheets

ELECTRICAL CONNECTOR HAVING FLOATING ALIGNMENT MEMBER

BACKGROUND OF THE INVENTION

The subject matter herein relates generally to electrical connectors, and more particularly to electrical connectors having floating alignment members.

In various receptacle connectors, devices are utilized to lock terminals in place and to assure that the terminals are in proper position within the receptacle connector. One such field is in the automotive field where the application typically requires a locking system for locking the terminals in place, as well as a terminal position assurance (TPA) device which assures that the terminals are in proper position longitudinally within the respective cavities. Typically, the locking system and TPA device cooperate to prevent mating of a corresponding plug connector, where some of the lines are open due to one or more terminals not being fully loaded.

Some known receptacle connectors may include an alignment plate within the mating cavity that receives the plug connector. The alignment plate is located within the mating cavity and supports the ends of the terminals to prevent stubbing during mating with the plug connector. As the plug connector is loaded into the mating cavity, the alignment plate is moved to a fully seated position and the terminals are fully cantilevered into the mating cavity and mated with the plug connector.

Known receptacle connectors with alignment plates are not without disadvantages. For instance, when the plug connectors are unmated and removed from the mating cavity, the terminals are exposed within the mating cavity. When the plug connector is no longer mated with the receptacle connector, the terminals are susceptible to damage from foreign objects introduced into the mating cavity. When the plug connector is again mated with the receptacle connector, the terminals are susceptible to damage from stubbing.

A need remains for a receptacle connector that provides protection to the terminals housed therein in a reliable and repeatable manner.

BRIEF DESCRIPTION OF THE INVENTION

In one embodiment, an electrical connector is provided including a dielectric housing having a mating cavity extending to a base wall and at least one terminal cavity through the base wall to the mating cavity. The terminal cavity being configured to receive a terminal therein having a pin extending into the mating cavity. A primary terminal lock extends from an interior wall of the housing and is configured to engage the terminal to retain the terminal in the terminal cavity. An alignment member is received within the mating cavity and has an alignment plate having at least one opening aligned with a corresponding terminal cavity. The alignment member is movable within the mating cavity between a seated position in which the alignment plate is proximate to the base wall and a supporting position in which the alignment plate is positioned remote from the base wall. A tip of the terminal is held within the opening when the alignment member is in the supporting position, and a pin base of the terminal is held within the opening when the alignment member is in the seated position.

Optionally, the alignment member may include a finger extending from the alignment plate, wherein the finger blocks the primary terminal lock when the alignment member is in at least one of the seated position and the supporting position. The alignment plate may be positioned a distance from the base wall when the alignment member is in the supporting position with the distance selected such that less than half of the pin extends beyond the alignment plate. The alignment member may be movable from the seated position to the supporting position and the alignment member may be movable from the supporting position to the seated position. Optionally, the housing may include at least one projection, and the alignment member may include a latch configured to engage the projection to hold the alignment member in the supporting position until the latch is released. The projection may hold the alignment member in the seated position until the latch is released. The housing may receive a mating connector in the mating cavity, wherein the mating connector is configured to release the latch and move the alignment member from the seated position to the supporting position.

In another embodiment, an electrical connector is provided including a dielectric housing having a mating cavity configured to receive a mating connector along a cavity axis. The dielectric housing has at least one terminal cavity opening to the mating cavity and the terminal cavity is configured to receive a terminal therein having a mating end extending into the mating cavity and configured for mating engagement with the mating connector. An alignment member is received within the mating cavity. The alignment member has an alignment plate having an opening for each terminal cavity where the opening is configured to receive and locate the mating end of the terminal. The alignment member is movable within the mating cavity in a mating direction and in a supporting direction opposite to the mating direction, wherein the mating direction is generally toward the terminal cavity and the supporting direction is generally away from the terminal cavity.

In a further embodiment, an electrical connector system is provided that includes a plug connector including a housing having a catch extending outward therefrom, and a receptacle connector for mating with the plug connector. The receptacle connector includes a dielectric housing having a mating cavity receiving the plug connector with at least one terminal cavity opening to the mating cavity. An alignment member is received within the mating cavity and has an alignment plate having an opening for each terminal cavity. The opening is configured to receive and locate a mating end of a terminal. The alignment member has a latch extending from the alignment plate and the alignment member is movable within the mating cavity in a mating direction and in a supporting direction opposite to the mating direction. The mating direction is generally toward the terminal cavity and the supporting direction is generally away from the terminal cavity. The catch of the plug connector engages the latch and pulls the alignment member in the supporting direction when the plug connector is unmated from the mating cavity.

DETAILED DESCRIPTION OF THE INVENTION

Figure 1:
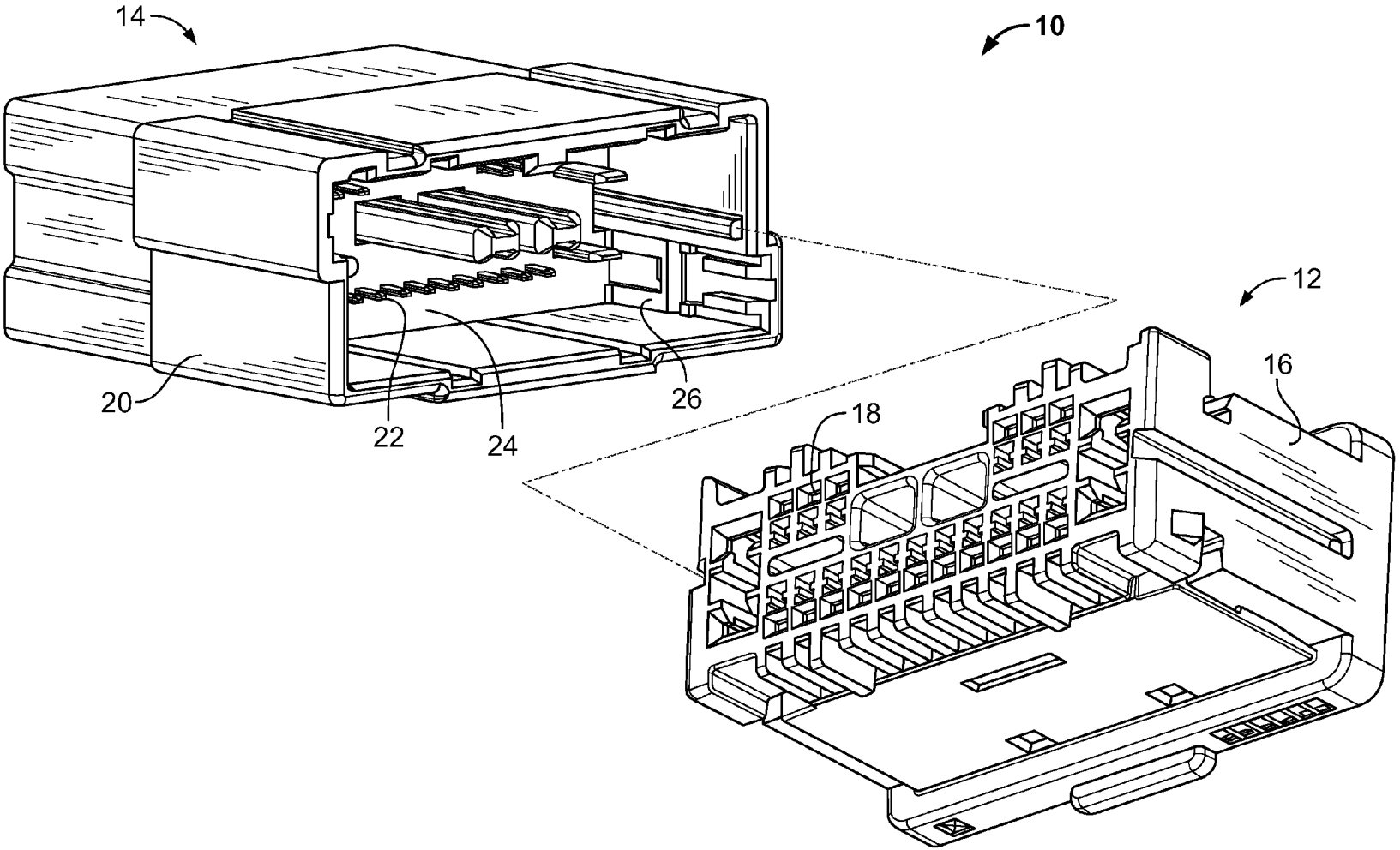
FIG. 1 illustrates a connector system including a plug connector and a receptacle connector formed in accordance with an exemplary embodiment.

FIG. 1 illustrates a connector system 10 including a plug connector 12 and a receptacle connector 14 formed in accordance with an exemplary embodiment. The plug connector 12 includes a dielectric housing 16 and a plurality of terminals 18 held within the housing 16. The receptacle connector 14 includes a dielectric housing 20 and a plurality of terminals 22 held within the housing 20. The plug and receptacle connectors 12, 14 are mated with one another such that the terminals 18 mate with the terminals 22.

In an exemplary embodiment, the receptacle connector 14 includes an alignment member 24 that receives and aligns the terminals 22 for mating engagement with the plug connector 12. The alignment member 24 includes latches 26 that selectively position the alignment member 24 within the housing 20, as will be described in further detail below. The alignment member 24 defines a floating alignment member that is capable of floating within the housing 20 along the terminals 22. For example, the alignment member 24 may float inward and outward along the terminals 22. As the alignment member 24 is moved inward, a greater portion of the terminals 22 is exposed or cantilevered beyond the end of the alignment member 24. As the alignment member 24 is moved outward, a greater portion of the terminals 22 is supported, thus reducing the risk of damaging the terminals 22, such as by stubbing the ends of the terminals 22, such as during shipping or handling of the receptacle connector 14 and/or during mating of the receptacle connector 14 with the plug connector 12. As will be described in further detail below, the alignment member 24 is movable between a terminal supporting (e.g. outward) position and a seated (e.g. inward) position, and may be moved back to the extended position from the seated position. In an exemplary embodiment, the alignment member 24 may also function as a terminal position assurance (TPA) device.

Figure 2:
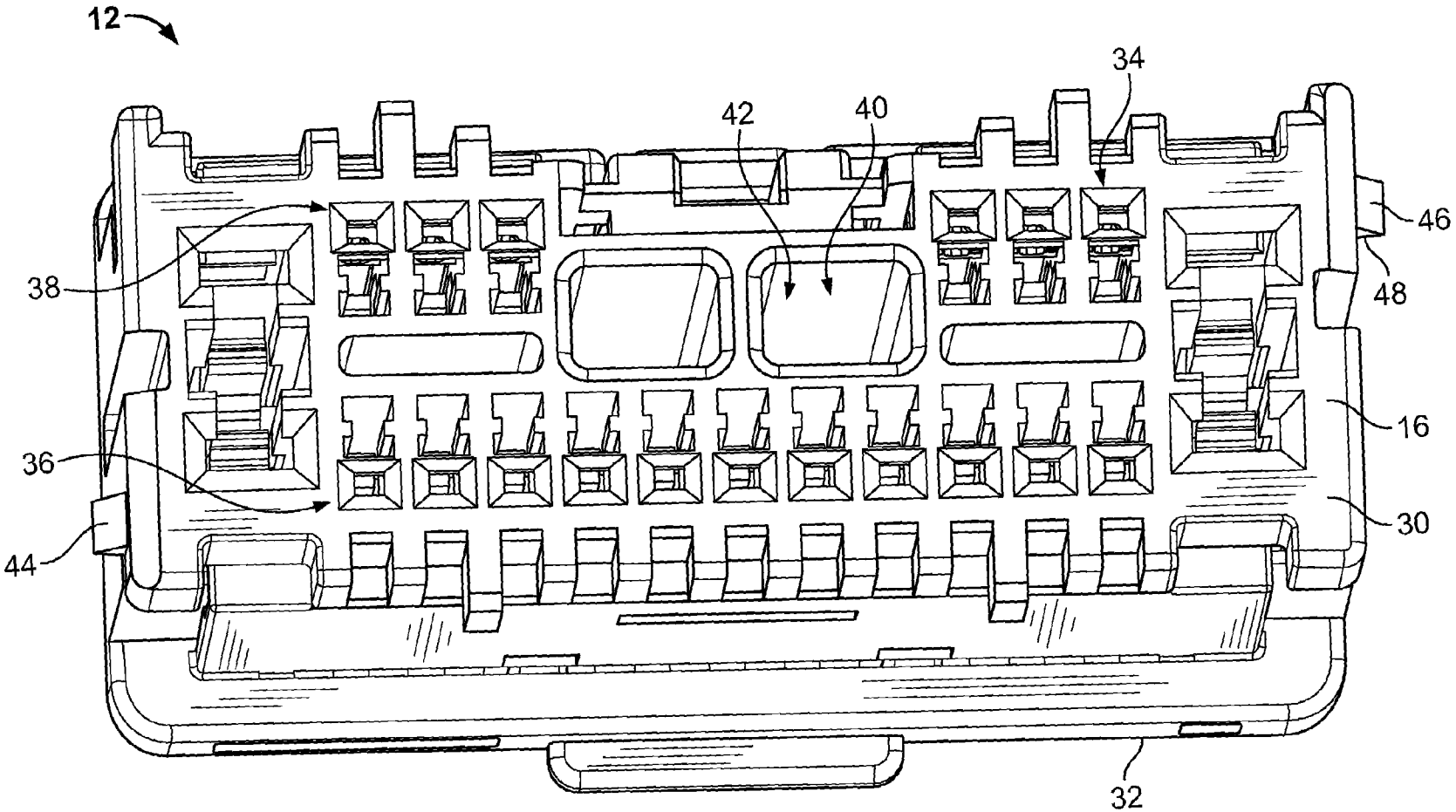
FIG. 2 is a front perspective view of the plug assembly shown in FIG. 1.

FIG. 2 is a front perspective view of the plug assembly 12. The housing 16 extends between a mating end 30 and a terminal loading end 32. The housing 16 includes a plurality of terminal cavities 34. In an exemplary embodiment, the terminal cavities 34 extend entirely between the mating end 30 and the terminal loading end 32. Each terminal cavity 34 is sized and designed to accommodate a terminal 18. The terminal cavities 34 are arranged in two rows 36, 38. The terminal cavity rows 36, 38 need not be identical to one another, and each terminal cavity 34 in a given row need not be identical to each other terminal cavity 34 in that row 36, 38. That is, the terminal cavities 34 may differ in size and/or number. The terminal cavities 34 within a row 36, 38 need not be aligned with one another. Additionally, more or less than two rows of terminal cavities 34 may be provided in alternative embodiments.

In the illustrated embodiment, the housing 16 includes a plurality of openings 40 at the mating end 30. The openings 40 provide access to channels 42 in the housing 16. As described in further detail below, the channels 42 receive beams or other projections of the receptacle connector 14 (shown in FIG. 1).

In an exemplary embodiment, the housing 16 includes a plurality of catches 44 extending from either side of the housing 16. The catches 44 include a first or forward facing ramp surface 46 and a second or rearward facing ramp surface 48. The surfaces 46, 48 may be angled or ramped at different angles. For example, the rearward facing ramp surface 48 may be approximately perpendicular with respect to the side of the housing 16 and the forward facing ramp surface 46 may be at approximately forty-five degrees with respect to the side of the housing 16.

Figure 3:
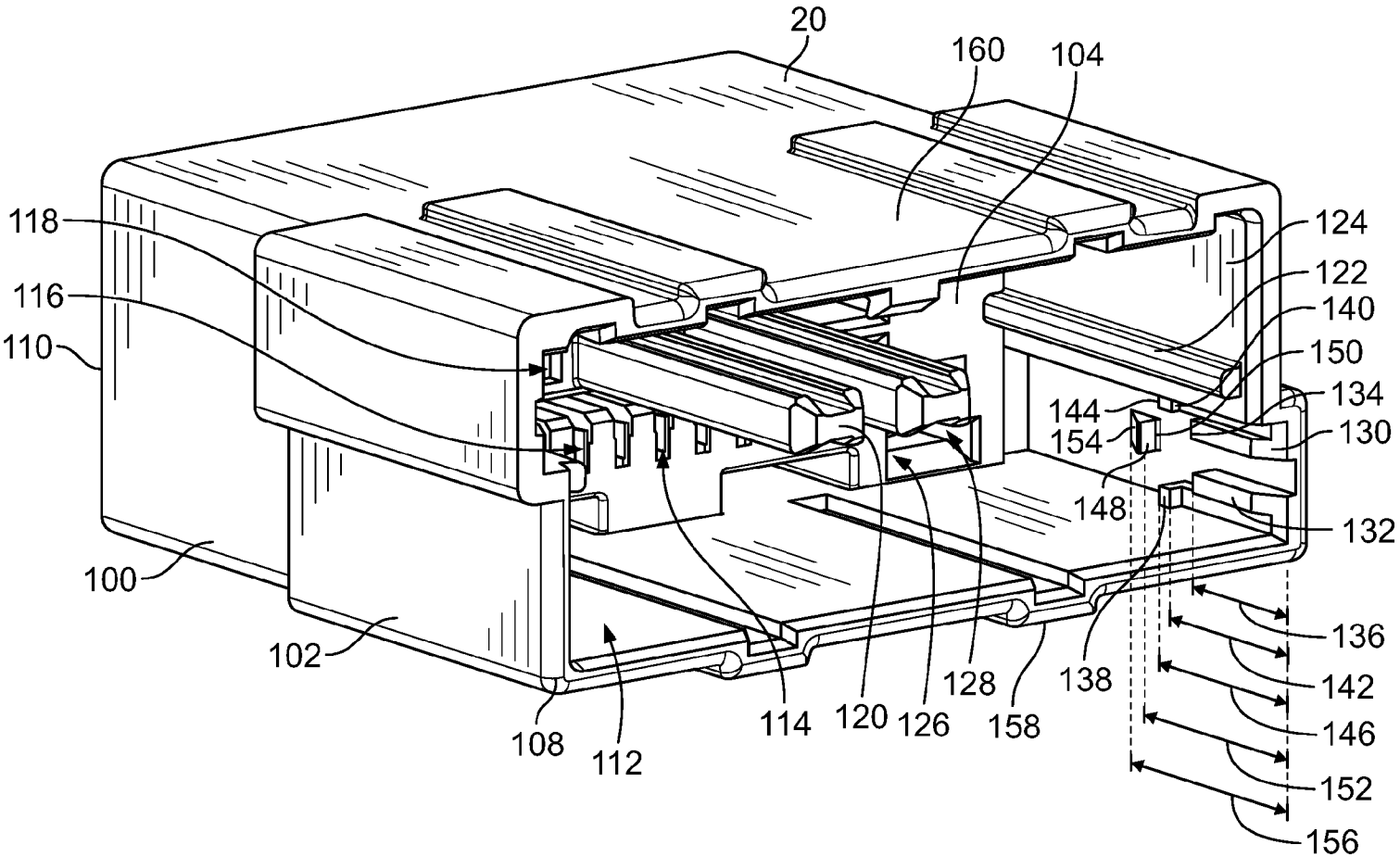
FIG. 3 is a front perspective view of a housing of the receptacle connector shown in FIG. 1.

FIG. 3 is a front perspective view of the housing 20 of the receptacle connector 14 (shown in FIG. 1). The housing 20 includes a main housing body 100 and a shroud 102 extending from the body 100. The body 100 includes a base wall 104 at a front end thereof, and the shroud 102 generally extends forward of the base wall 104. The housing 20 extends between a mating end 108 and a terminal loading end 110. The body 100 extends between the terminal loading end 110 and the base wall 104. The shroud 102 extends between the base wall 104 and the mating end 108. The shroud 102 forms a mating cavity 112 that is configured to receive the plug connector 12 (shown in FIG. 2). The mating cavity 112 extends between the base wall 104 and the mating end 108.

The housing 20 includes a plurality of terminal cavities 114. In an exemplary embodiment, the terminal cavities 114 extend through the body 100 between the terminal loading end 110 and the base wall 104. The terminal cavities 114 open to the mating cavity 112. Each terminal cavity 114 is sized and designed to accommodate a terminal 22 (shown in FIG. 1). The terminal cavities 114 are arranged in two rows 116, 118. The terminal cavity rows 116, 118 need not be identical to one another, and each terminal cavity 114 in a given row need not be identical to each other terminal cavity 114 in that row 116, 118. That is, the terminal cavities 114 may differ in size and/or number. The terminal cavities 114 within a row 116, 118 need not be aligned with one another. Additionally, more or less than two rows of terminal cavities 114 may be provided in alternative embodiments.

In an exemplary embodiment, the housing 20 includes beams 120 extending into the mating cavity 112 from the base wall 104. The beams 120 may be used to support and/or guide the alignment member 24 (shown in FIG. 1), as described in further detail below. The beams 120 may be used to key and/or align the plug connector 12 within the mating cavity 112 during mating with the receptacle connector 14. In the illustrated embodiment, two beams 120 are provided that are substantially centrally located within the mating cavity 112. However, any number of beams 120 may be utilized, and the position of the beams 120 may vary in alternative embodiments.

The housing 20 includes rails 122 provided along sides 124 of the shroud 102. The rails 122 may be used to support and/or guide the alignment member 24, as described in further detail below. The rails 122 may be used to key and/or align the plug connector 12 within the mating cavity 112 during mating with the receptacle connector 14.

In the illustrated embodiment, the housing 20 includes a plurality of openings 126 in the base wall 104. The openings 126 provide access to channels 128 in the body 100. As described in further detail below, the channels 128 receive fingers or other projections of the alignment member 24.

The housing 20 includes a plurality of projections 130 extending from the sides 124 of the shroud 102. The projections 130 are configured to interface with the latches 26 (shown in FIG. 1) of the alignment member 24 to position the alignment member 24 within the mating cavity 112. In an exemplary embodiment, the projections 130 are arranged at different depths from the mating end 108. For example, first or forward projections 132 are arranged with rear facing surfaces 134 at a first depth 136 from the mating end 108. Second or intermediate projections 138 are arranged with forward facing surfaces 140 at a second depth 142 and rear facing surfaces 144 at a third depth 146. A third or rear projection 148 is arranged with a forward facing surface 150 at a fourth depth 152 and rear facing surface 154 at a fifth depth 156. Any number of projections may be provided at any depth level, and in the illustrated embodiment, two forward projections 132, two intermediate projections 138 and one rear projection 148 are provided. The three depths allow the alignment member 24 to be positioned at three different stages or positions within the mating cavity 112. More or less stages of projections may be provided to position the alignment member 24 at more or less locations. The surfaces of the projections may be flat and generally perpendicular to the side 124, or alternatively, may be angled or curved. In the illustrated embodiment, one of the projections 130 is arranged proximate a bottom 158 of the shroud 102 on one of the sides 124 and another projection 130 is arranged proximate a top 160 of the shroud 102 on the other side 124 of the shroud 102. The projections 130 may be arranged differently in alternative embodiments.

Figure 4:
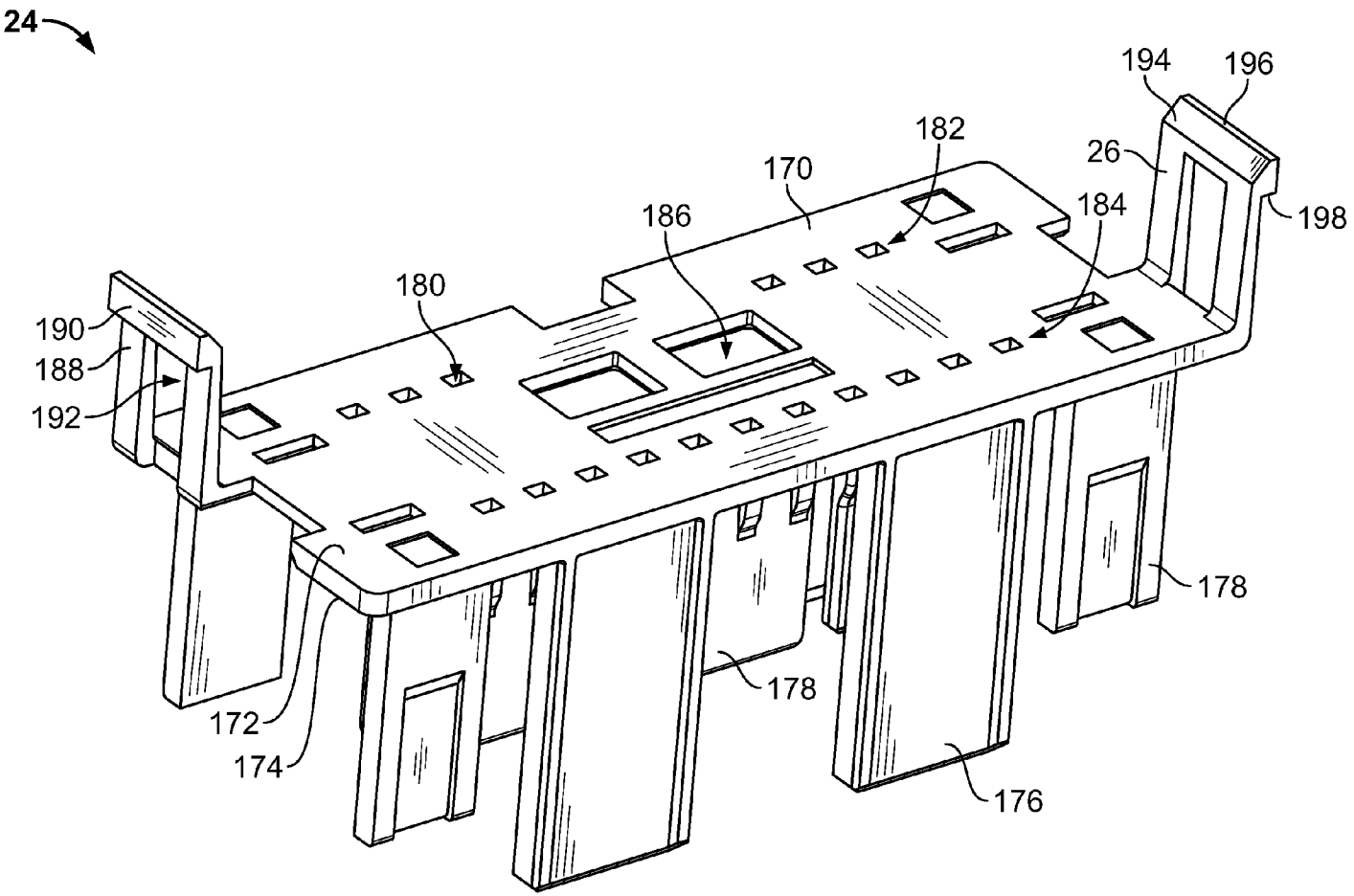
FIG. 4 illustrates an alignment member of the receptacle connector shown in FIG. 1.

FIG. 4 illustrates the alignment member 24 of the receptacle connector 14 (shown in FIG. 1). The alignment member 24 includes an alignment plate 170 having a front side 172 and a rear side 174. The latches 26 extend forward from the front side 172. A plurality of stabilizers 176 extend rearward from the rear side 174. A plurality of fingers 178 extend rearward from the rear side 174.

The stabilizers 176 are loaded through the openings 126 (shown in FIG. 3) into the channels 128 (shown in FIG. 3). The stabilizers 176 orient and/or guide the alignment member 24 into engagement with the housing 20 (shown in FIG. 3). Any number of stabilizers 176 may be used and the positions of the stabilizers 176 may vary in alternative embodiments.

The fingers 178 are loaded through the openings 126 into the channels 128. In an exemplary embodiment, the fingers 178 are used to assure proper positioning of the terminals 22 (shown in FIG. 1), as described in further detail below. Any number of fingers 178 may be used and the positions of the fingers 178 may vary in alternative embodiments.

The alignment plate 170 includes a plurality of openings 180 extending therethrough. The openings 180 receive the terminals 22 when the alignment member 24 is loaded into the housing 20 (shown in FIG. 1). In an exemplary embodiment, the openings 180 correspond to the terminal cavities 114 (shown in FIG. 2). The openings 180 may be sized and positioned to complement the terminal cavities 114 and receive the terminals 22 extending from the terminal cavities 114. For example, each opening 180 may be sized and positioned to accommodate one of the terminals 22, however, the openings 180 may accommodate more than one terminal 22 in alternative embodiments. In the illustrated embodiment, twenty-one openings 180 are arranged in two rows 182, 184, with eight openings 180 in the first row 182 and thirteen openings 180 arranged in the second row 184. The rows 182, 184 need not be identical to one another, and each opening 180 in a given row need not be identical to each other opening 180 in that row 182, 184. For example, different openings 180 may accommodate different sized or shaped terminals 22. The openings 180 may differ in size and/or number. The openings 180 within a row 182, 184 need not be aligned with one another. Additionally, more or less than two rows of openings 180 may be provided in alternative embodiments.

In an exemplary embodiment, each opening 180 includes an associated finger 178 that is positioned adjacent the opening 180. For example, the finger 178 may extend rearward from the rear side 174 from an area of the alignment plate 170 proximate the opening 180. In the illustrated embodiment, the fingers 178 are positioned either immediately above or immediately below the openings 180. Optionally, the fingers 178 may accommodate multiple openings 180, however, the openings 180 may have a dedicated finger 178 that is associated only with that particular opening 180.

The alignment plate 170 includes a plurality of beam openings 186 that receive the beams 120 (shown in FIG. 3) of the housing 20. In the illustrated embodiment, the beam openings 186 may be used to key and/or align the alignment member 24 within the mating cavity 112 (shown in FIG. 3). In the illustrated embodiment, two beam openings 186 are provided that are substantially centrally located with respect to the alignment plate 170. However, any number of beam openings 186 may be utilized, and the location of the beam openings 186 may vary in alternative embodiments.

The latches 26 each include a pair of legs 188 extending perpendicularly from the alignment plate 170 in a forward direction. A foot 190 is provided at the distal end of the legs 188. A slot 192 is defined by the legs 188 and foot 190. In an exemplary embodiment, the foot 190 includes a ramped inner surface 194 extending toward a tip 196 that defines an outer surface of the latch 26. The tip 196 is generally forward facing. The foot 190 includes a catch surface 198 that is generally rearward facing. The catch surface 198 is generally parallel to, and spaced apart from, the tip 196. One of the latches 26 is provided near the bottom of the alignment plate 170 and the other latch 26 is provided near the top of the alignment plate 170. The latches 26 may be arranged differently in alternative embodiments.

Figure 5:
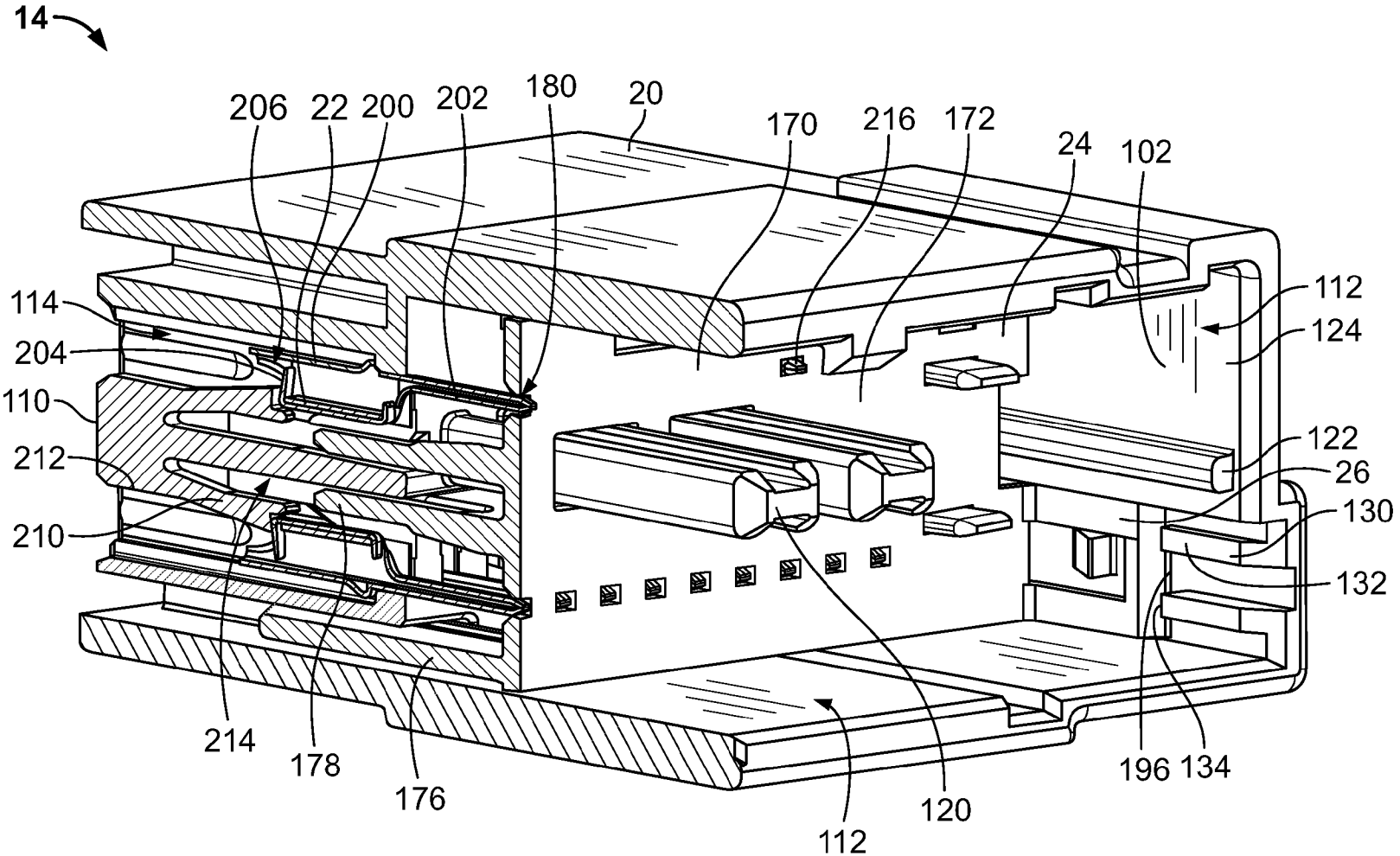
FIG. 5 is a partial cross-sectional view of the receptacle connector with the alignment member in an extended position.

FIG. 5 is a partial cross-sectional view of the receptacle connector 14 with the alignment member 24 in an extended position. As described above, the alignment member 24 is movable within the mating cavity 112 between various positions. The latch 26 and the projections 130 interact to control the position (e.g. depth) of the alignment member 24 within the mating cavity 112. In the extended position, the latch 26 engages the forward projections 132. In the extended position, the housing 20 is configured to accept the terminals 22. For example, the alignment member 24 may be initially loaded into the mating cavity 112 through the mating end 108 to the extended position. The assembly may then be sent to a harness maker or another assembly station for loading the terminals 22 into the terminal cavities 114.

In an exemplary embodiment, the terminals 22 are pin terminals having a main body 200 and a pin 202 extending from a front of the main body 200. The main body 200 includes an engagement surface 204. In an exemplary embodiment, the engagement surface 204 is generally rearward facing and positioned at a rear or terminating end 206 of the terminal 22. The terminal 22 may be terminated to a wire at the terminating end 206.

The housing 20 includes a plurality of primary terminal locks 210 extending from an interior wall 212 of the housing 20. The locks 210 are configured to extend at least partially into the terminal cavities 114. During loading, the terminals 22 are loaded into the terminal cavities 114 through the terminal loading end 110 at least until the locks 210 catch behind the engagement surface 204 of the terminals 22. As the terminals 22 pass the locks 210, the locks 210 are forced out of the terminal cavities 114 into a void 214. Once the terminal 22 is loaded to a fully loaded position, the locks 210 are free to return at least partially into the terminal cavities 114 to a blocking position. The locks 210 retain the terminals 22 in the terminal cavities 114 by resisting rearward movement of the terminals 22 within the terminal cavities 114 by blocking the engagement surface 204.

As described above, the alignment member 24 operates as a TPA device. The fingers 178 of the alignment member 24 are configured to at least partially fill the void 214 and resist outward movement of the locks 210. If the fingers 178 were positioned within the voids 214 during loading of the terminals 22, the locks 210 would be restricted from flexing outward into the void 214 and the terminal 22 would be blocked from being loaded to the final position. When the alignment member 24 is in the extended position, the fingers 178 are positioned forward of the void 214 and the lock 210. As such, in the extended position, the fingers 178 are in an unblocking position, which allow the locks 210 to flex into the voids 214. The alignment member 24 is initially positioned in the extended position and sent to the harness maker or other assembly stage for loading the terminals 22 into the terminal cavities 112.

When the terminals 22 are in the fully loaded positions, the pins 202 are at least partially received in the openings 180 in the alignment plate 170. Optionally, the pin 202 may engage at least one of the walls defining the opening 180 such that the pin 202 is directly supported by the alignment plate 170. The walls of the opening 180 may engage each side of the pin 202 to resist both vertical and horizontal movement of the pin 202. Optionally, a tip 216 of each pin 202 may extend slightly beyond the front side 172 of the alignment plate 170. As such, the pins 202 are at least partially supported by the alignment plate 170 when the alignment member 24 is in the extended position.

In an exemplary embodiment, the alignment member 24 is held in the extended position by the latch 26. For example, the tip 196 of the latch 26 engages the rear facing surfaces 134 of the forward projections 132 to resist forward movement of the alignment member 24. Similarly, the catch surface 198 (shown in FIG. 4) of the latch 26 engages the forward facing surfaces 140 (shown in FIG. 3) of the intermediate projections 138 (shown in FIG. 3) to resist rearward movement of the alignment member 24. The alignment member 24 may be moved from the extended position by releasing the latch 26. For example, a tool or other component may be used to force the latch 26 away from the side 124 of the shroud 102, after which the alignment member 24 may be moved to a different depth within the mating cavity 112.

The movement of the alignment member 24 may be controlled or guided by various features of the alignment member 24 and/or the housing 20. In an exemplary embodiment, the beams 120 and/or the rails 122 of the housing 20 may be used to guide the alignment member 24 within the mating cavity 112. In addition, or alternatively, the stabilizers 176 and or the fingers 178 may be utilized to guide the alignment member 24 within the mating cavity 112. In addition, or alternatively, the outer perimeter of the alignment plate 170 and the inner surfaces of the shroud 102 may be used to guide the alignment member 24 within the mating cavity 112.

Figure 6:
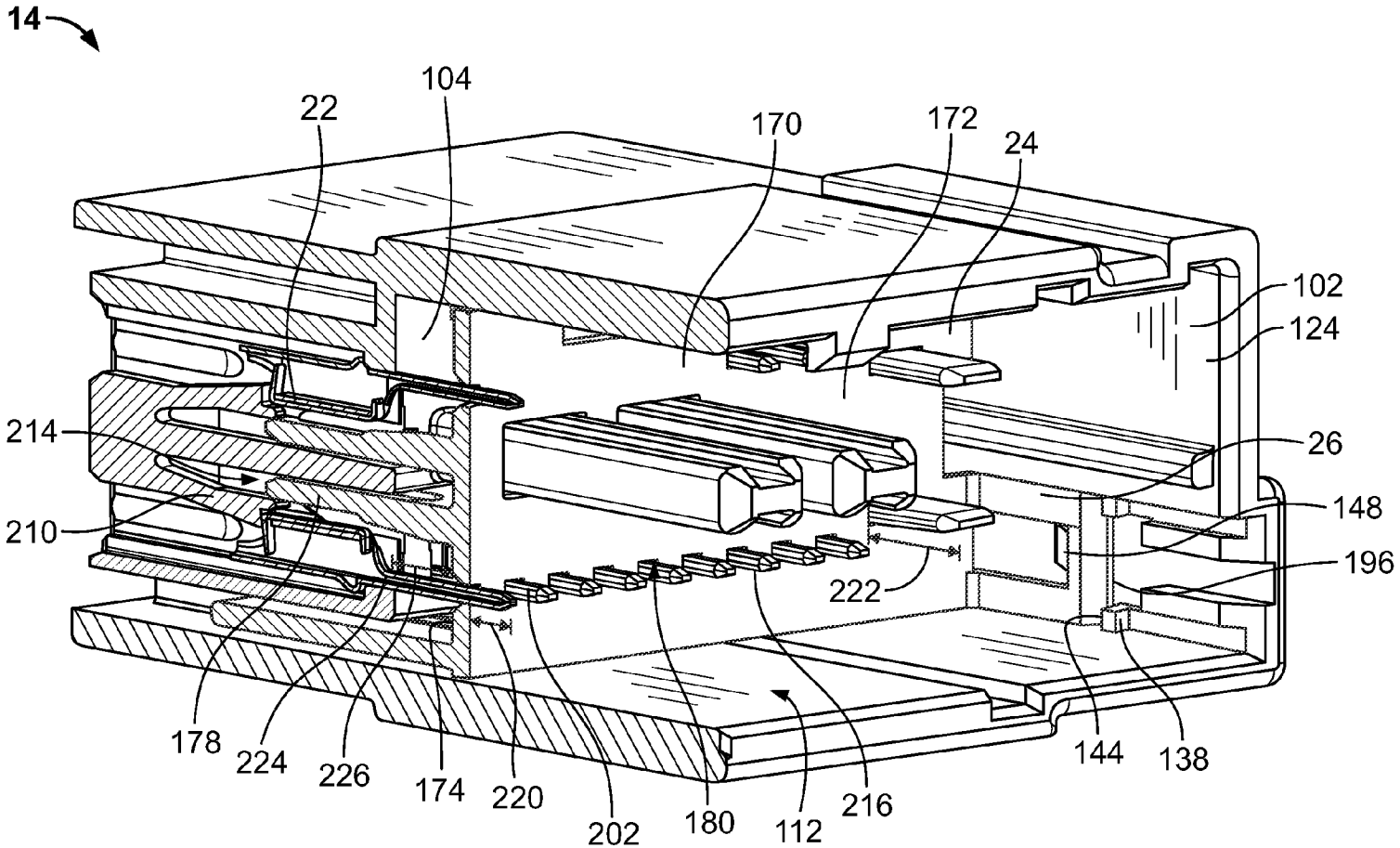
FIG. 6 is a partial cross-sectional view of the receptacle connector with the alignment member in a supporting position.

FIG. 6 is a partial cross-sectional view of the receptacle connector 14 with the alignment member 24 in a terminal supporting position. The alignment member 24 is transferred from the extended position (shown in FIG. 5) to the supporting position (shown in FIG. 6) by pushing or moving the alignment member 24 inward. The alignment plate 170 is positioned relatively closer to the base wall 104 than in the extended position. As described above, the alignment member 24 may be moved to the supporting position from the extended position by releasing the latch 26 or otherwise forcing the latch 26 rearward of the forward projections 132.

In the supporting position, the pins 202 of the terminals 22 are supported by the alignment plate 170. The pins 202 extend through the openings 180 such that a portion of the pins 202 are cantilevered from the alignment plate 170. For example, the tips 216 may be positioned a distance 220 from the front side 172 of the alignment plate 170. Optionally, at least some of the pins 202 may extend a distance 222 that is greater than the distance 220, such as with pins 202 that are longer. A base 224 of each pin 202 is positioned a distance 226 from the rear side 174 of the alignment plate 170 such that a supported portion of the pin 202 is located between the alignment plate 170 and the base wall 104. Optionally, the pin 202 may engage at least one of the walls defining the opening 180 such that the pin 202 is directly supported by the alignment plate 170. The walls of the opening 180 may engage each side of the pin 202 to resist both vertical and horizontal movement of the pin 202.

By controlling the depth of the alignment plate 24 at the supporting position, the amount of cantilever of the pins 202 may be controlled. For example, by reducing the amount of cantilever, less of the pin 202 is exposed. Shorter pins 202 are less susceptible to damage, such as from stubbing or from foreign objects introduced into the mating cavity 112. Optionally, the distance 220 may be selected such that less than half of the pin 202 extends beyond the alignment plate 170.

In an exemplary embodiment, in the supporting position, the fingers 178 of the alignment member 24 are in a blocking position with respect to the locks 210. For example, portions of the fingers 178 may be axially alignment with the locks 210, thus blocking the locks 210 from flexing into the voids 214. The fingers 178 thus operate to lock the locks 210 in a blocking position with respect to the terminals 22. As such, the receptacle connector 14 may be handled and/or transported without the risk of the terminals 22 becoming unloaded. The receptacle connector 14 may be sent to the end user, such as the automotive assembly plant, in such a condition.

The alignment member 24 is held in the supporting position by the latch 26. For example, the tip 196 of the latch 26 engages the rear facing surfaces 144 of the intermediate projections 138 to resist forward movement of the alignment member 24. Similarly, the catch surface 198 (shown in FIG. 4) of the latch 26 engages the forward facing surface 150 (shown in FIG. 3) of the rear projection 148 to resist rearward movement of the alignment member 24. The alignment member 24 may be moved from the supporting position by releasing the latch 26. In an exemplary embodiment, the plug connector 12 (shown in FIG. 1) is configured to force the latch 26 away from the side 124 of the shroud 102 during mating with the receptacle connector 14, after which the alignment member 24 may be moved to a different depth within the mating cavity 112.

Figure 7:
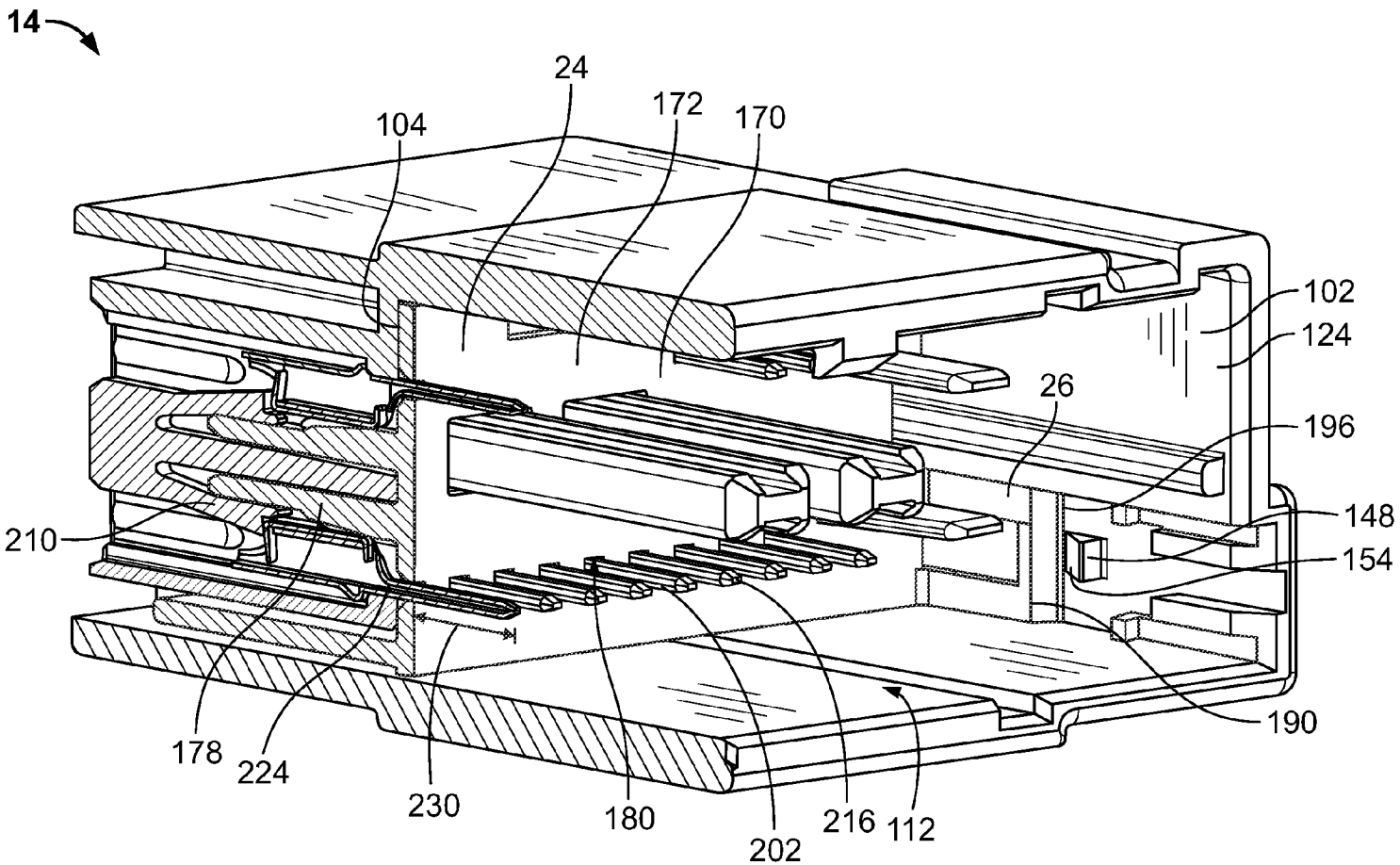
FIG. 7 is a partial cross-sectional view of the receptacle connector with the alignment member in a seated position.

FIG. 7 is a partial cross-sectional view of the receptacle connector 14 with the alignment member 24 in a seated position. The alignment member 24 is transferred from the supporting position (shown in FIG. 6) to the seated position (shown in FIG. 7) by pushing or moving the alignment member 24 inward toward the base wall 104. In the seated position, the alignment plate 170 is positioned relatively closer to the base wall 104 than in the extended position. Optionally, the alignment plate 170 may be positioned adjacent to the base wall 104 in the seated position. As described above, the alignment member 24 may be moved to the seated position from the supporting position by releasing the latch 26.

In the seated position, the pins 202 of the terminals 22 extend through the openings 180 such that the pins 202 are cantilevered from the alignment plate 170. For example, the tips 216 may be positioned a distance 230 from the front side 172 of the alignment plate 170. The distance 230 is greater than the distance 220 (shown in FIG. 6) such that more of the pin 202 is cantilevered from the alignment plate 170. The alignment plate 170 may be positioned proximate to the bases 224 of the pins 202. Optionally, the bases 224 may be held within the openings 180.

In the seated position, the plug connector 12 (shown in FIG. 1) may be fully mated with the receptacle connector 14, as opposed to the supporting position in which the plug connector 12 cannot be fully mated with the receptacle connector 14. The pins 202 may extend from the alignment plate 170 a sufficient distance to mate with the terminals 18 (shown in FIG. 1) of the plug connector 12. In an exemplary embodiment, in the seated position, the fingers 178 of the alignment member 24 are in a blocking position with respect to the locks 210.

The alignment member 24 is held in the seated position by the latch 26. For example, the tip 196 of the latch 26 engages the rear facing surface 154 of the rear projection 148 to resist forward movement of the alignment member 24. The base wall 104 may resist rearward movement of the alignment member 24. The alignment member 24 may be moved from the seated position by releasing the latch 26. In an exemplary embodiment, when the plug connector 12 is unmated and removed from the mating cavity 112, the plug connector 12 is configured to force the latch 26 away from the side 124 of the shroud 102, such as by forcing the latch 26 to ride along the rear ramp surface of the rear projection 148. The plug connector 12 also engages the foot 190 and pulls the latch 26, and thus the alignment member 24 outward, such as back to the supporting position (shown in FIG. 6).

Figure 8:
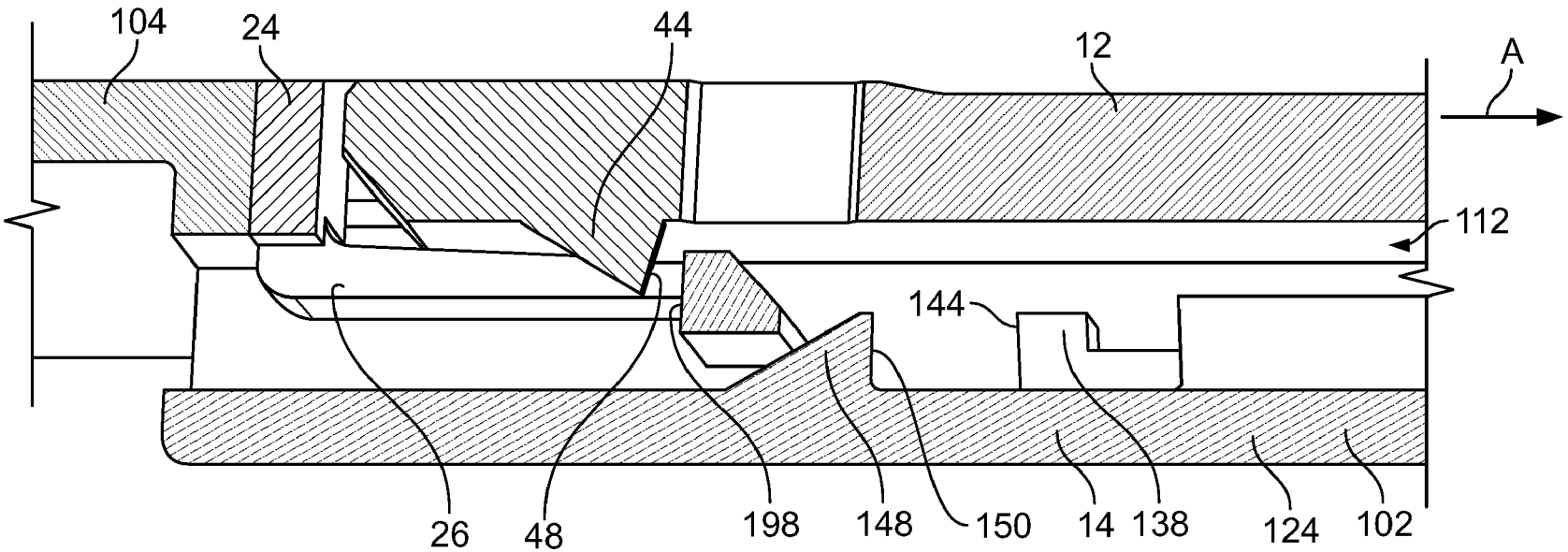
FIG. 8 is a partial cross-sectional view of the plug connector mated with the receptacle connector.

FIG. 8 is a partial cross-sectional view of the plug connector 12 mated with the receptacle connector 14. FIG. 8 illustrates the receptacle connector 14 with the alignment member 24 in the seated position against the base wall 104. The plug connector 12 abuts the alignment member 24. In operation, when the plug connector 12 is unmated or otherwise removed from the mating cavity 112 in an un-mating direction, such as in the direction of arrow A, the catch 44 engages the latch 26. For example, the rearward facing ramp surface 48 engages the catch surface 198 and generally pulls the latch 26 rearward as the plug connector 12 is unmated.

Once the latch 26 clears the forward facing surface 150 of the rear projection 148, the tip 196 engages the rear facing surface 144 of the intermediate projection 138 to resist forward movement of the alignment member 24. Further pulling on the plug connector 12 in the un-mating direction, deflects the latch 26 outward toward the side 124 of the shroud 102. For example, the rearward facing ramp surface 48 forces the latch 26 outward until the tip of the catch 44 clears the latch 26. The plug connector 12 is then removed without further rearward movement of the alignment member 24. As such, the alignment member 24 is automatically moved from the seated position to the supporting position by the plug connector 12.

A connector system 10 is thus provided that may be manufactured in a cost effective and reliable manner. The connector system 10 includes the plug connector 12 and the receptacle connector 14. The receptacle connector 14 has a floating alignment member 24 that is movable between a plurality of positions. The alignment member 24 is positionable in a supporting position that is away from a base wall 104 to support the pins 202 of the terminals 22. By supporting the pins 202 close to the tips 216, the pins 202 are less susceptible to damage, such as from stubbing. When the plug connector 12 is mated with the receptacle connector 14, the alignment member 24 is positioned in a seated position against the base wall 104. In an exemplary embodiment, when the plug connector 12 is unmated and removed from the mating cavity 112, the plug connector 12 is configured to pull the alignment member 24 back to the supporting position, such that the alignment member 24 again supports and protects the pins 202. The receptacle connector 14 includes the latch 26 on the alignment member 24 and projections 130 on the housing 20. The projections 130 are configured to hold the latch 26 in the various positions. In an exemplary embodiment, three stages of projections 130 are provided that hold the latch in three different positions. Optionally, the alignment member 24 may also function as a TPA device.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a dielectric housing having a mating cavity configured to receive a mating connector along a cavity axis, the dielectric housing having projections extending into the mating cavity, the dielectric housing having at least one terminal cavity opening to the mating cavity, the terminal cavity being configured to receive a terminal therein having a mating end extending into the mating cavity and configured for mating engagement with the mating connector; and an alignment member received within the mating cavity, the alignment member having an alignment plate having an opening for each terminal cavity, the opening being configured to receive and locate the mating end of the terminal, the alignment member having a latch extending therefrom, the latch engaging the projections to selectively position the alignment member within the mating cavity, the alignment member being movable within the mating cavity in a mating direction and in a supporting direction opposite to the mating direction, the mating direction being toward the terminal cavity and the supporting direction being away from the terminal cavity.

2. The electrical connector of claim 1, wherein the alignment member is automatically moved in the supporting direction by the mating connector when the mating connector is unmated from the housing, the alignment member being moved in the supporting direction by the mating connector until the latch engages a corresponding one of the projections.

3. The electrical connector of claim 1, wherein the housing includes a mating end and a base wall, the mating cavity extends between the mating end and the base wall, the projections being positioned between the mating end and the base wall, the alignment member being movable within the mating cavity in the mating direction until the alignment member engages the base wall.

4. The electrical connector of claim 1, wherein at least one of the projections includes a forward facing surface and a rear facing surface, the forward and rear facing surfaces being ramped at non-orthogonal angles with respect to the direction of movement of the alignment member within the mating cavity such that the latch rides along the forward and rear facing surfaces as the alignment member is moved in the supporting direction and the mating direction.

5. The electrical connector of claim 1, wherein the projections comprise a first projection, a second projection and a third projection at first second and third depths from a mating end of the dielectric housing, the alignment member is movable away from the mating end in the mating direction from an extended position to a supporting position and from the supporting position to a seated position;

when in the extending position, the latch being restricted from movement in the supporting direction by the first projection;

when in the supporting position, the latch being restricted from movement in the supporting direction by the second projection; and when in the seated position, the latch being restricted from movement in the supporting direction by the third projection.

6. The electrical connector of claim 5, wherein when in the extending position, the latch being restricted from movement in the mating direction by the second projection; and when in the supporting position, the latch being restricted from movement in the mating direction by the third projection.

7. An electrical connector system comprising:

a plug connector including a housing having a catch extending outward therefrom; and a receptacle connector for mating with the plug connector, the receptacle connector comprising:

a dielectric housing having a mating cavity receiving the plug connector, the dielectric housing having at least one terminal cavity opening to the mating cavity; and an alignment member received within the mating cavity, the alignment member having an alignment plate having an opening for each terminal cavity, the opening being configured to receive and locate a mating end of a terminal, the alignment member having a latch extending from the alignment plate, the latch engaging the dielectric housing to hold the alignment member in the mating cavity, the alignment member being movable within the mating cavity in a mating direction and in a supporting direction opposite to the mating direction, the mating direction being toward the terminal cavity and the supporting direction being away from the terminal cavity, wherein the catch of the plug connector engages the latch and pulls the alignment member in the supporting direction when the plug connector is unmated from the mating cavity.

8. The electrical connector system of claim 7, wherein the plug connector engages the alignment plate and forces the alignment member in the mating direction when the plug connector is loaded into the mating cavity.

9. The electrical connector system of claim 7, wherein the housing includes a first projection, a second projection and a third projection at first second and third depths from a mating end of the dielectric housing, the first second and third projections extending into the mating cavity, the alignment member is movable away from the mating end in the mating direction from an extended position to a supporting position and from the supporting position to a seated position;

when in the extending position, the latch being restricted from movement in the supporting direction by the first projection;

when in the supporting position, the latch being restricted from movement in the supporting direction by the second projection; and when in the seated position, the latch being restricted from movement in the supporting direction by the third projection.

10. The electrical connector system of claim 7, wherein the dielectric housing includes a plurality of projections extending into the mating cavity, the latch engaging different projections as the alignment member is moved within the mating cavity.

11. The electrical connector system of claim 10, wherein the catch includes a catch ramp surface, the catch ramp surface engaging the latch when the plug connector is unmated from the mating cavity, the catch ramp surface pulling the latch in the supporting direction as the plug connector is unmated from the mating cavity, the latch being deflected outward from the dielectric housing when the latch engages one of the projections until the catch clears the latch, the plug connector being movable in an unmating direction independent of the latch after the catch clears the latch.

12. An electrical connector comprising:

a dielectric housing having a housing body and a shroud extending forward from a base wall of the housing body along a cavity axis, the shroud having shroud walls defining a mating cavity configured to receive a mating connector, the shroud having at least one projection extending inward into the mating cavity, the housing body having a terminal cavity extending through the base wall and open to the mating cavity, the terminal cavity being configured to receive a terminal therein having a mating end extending into the mating cavity and configured for mating engagement with the mating connector;

a primary terminal lock extending into the terminal cavity, the primary terminal lock being configured to engage the terminal to retain the terminal in the terminal cavity;

an alignment member received within the mating cavity, the alignment member having an alignment plate having an opening aligned with the terminal cavity, the alignment member being movable within the mating cavity between a seated position in which the alignment plate is proximate to the base wall and a supporting position in which the alignment plate is positioned remote from the base wall; and a latch extending from the alignment member, the latch engaging the at least one projection to hold the alignment member in at least one of the supporting position and the seated position.

13. The electrical connector of claim 12, wherein the alignment member is automatically moved in a supporting direction from the seated position to the supporting position by the mating connector when the mating connector is unmated from the housing, the alignment member being moved in the supporting direction by the mating connector until the latch engages a corresponding one of the projections.

14. The electrical connector of claim 12, wherein the at least one projection comprise a first projection, a second projection and a third projection at first second and third depths from a mating end of the shroud, the alignment member is movable away from the mating end in a mating direction from an extended position to the supporting position and from the supporting position to the seated position, and the alignment member being movable in a supporting direction opposite to the mating direction;

when in the extending position, the latch being restricted from movement in the supporting direction by the first projection;

when in the supporting position, the latch being restricted from movement in the supporting direction by the second projection; and when in the seated position, the latch being restricted from movement in the supporting direction by the third projection.

15. The electrical connector of claim 12, wherein when the alignment member is in the extending position, the latch is restricted from movement in the mating direction by the second projection; and when the alignment member is in the supporting position, the latch is restricted from movement in the mating direction by the third projection.

16. The electrical connector of claim 12, wherein at least one of the at least one projections includes a forward facing surface and a rear facing surface, the forward and rear facing surfaces being ramped at non-orthogonal angles with respect to the direction of movement of the alignment member within the mating cavity such that the latch rides along the forward and rear facing surfaces as the alignment member is moved between the supporting and seated positions.

17. The electrical connector of claim 12, wherein the alignment member includes a finger extending from the alignment plate, the finger blocking the primary terminal lock when the alignment member is in at least one of the seated position and the supporting position.

18. The electrical connector of claim 12, wherein the latch is captured between two projections of the at least one projections when the alignment member is in the supporting position, the two projections resisting forward and rearward movement of the alignment member.

19. The electrical connector of claim 12, wherein the alignment member is positionable within the mating cavity in an extended position in which a tip of the terminal is held within the opening and in which the primary terminal locks are configured to be flexed outward during loading of the terminal into the terminal cavity, wherein the alignment member is configured to block the primary terminal lock from flexing outward when the alignment member is in the supporting position and when the alignment member is in the seated position.

* * * * *